US009822947B2

(12) United States Patent
Owada

(10) Patent No.: US 9,822,947 B2
(45) Date of Patent: Nov. 21, 2017

(54) LENS MEMBER AND VEHICLE LIGHTING UNIT

(71) Applicant: Stanley Electric Co., Ltd., Tokyo (JP)

(72) Inventor: Ryotaro Owada, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 135 days.

(21) Appl. No.: 14/834,819

(22) Filed: Aug. 25, 2015

(65) Prior Publication Data

US 2016/0053967 A1 Feb. 25, 2016

(30) Foreign Application Priority Data

Aug. 25, 2014 (JP) ..... 2014-170208

(51) Int. Cl.
*F21V 7/00* (2006.01)
*F21V 13/04* (2006.01)
(Continued)

(52) U.S. Cl.
CPC ..... *F21V 7/0091* (2013.01); *F21S 48/1104* (2013.01); *F21S 48/1159* (2013.01);
(Continued)

(58) Field of Classification Search
CPC ..... F21V 13/04; F21V 7/09; F21V 7/0091; F21S 48/1159; F21S 48/1241; F21S 48/1329
(Continued)

(56) References Cited

U.S. PATENT DOCUMENTS

2003/0214815 A1* 11/2003 Ishida ..... F21S 48/1159 362/516
2004/0156209 A1* 8/2004 Ishida ..... F21S 48/1154 362/516

(Continued)

FOREIGN PATENT DOCUMENTS

EP 1 715 245 A1 10/2006
JP 4047186 B2 2/2008

OTHER PUBLICATIONS

Extended European search report for the related European Patent Application No. 15182292.1 dated Feb. 10, 2016.

*Primary Examiner* — Andrew Coughlin
*Assistant Examiner* — Michael Chiang
(74) *Attorney, Agent, or Firm* — Kenealy Vaidya LLP

(57) ABSTRACT

A lens member in front of a light source can include: an incident portion dividing the entering light rays into first light rays obliquely upward and forward and second light rays obliquely upward and rearward; a first reflecting surface reflecting the first light rays; a second reflecting surface reflecting the second light rays; a third reflecting surface reflecting the second light rays reflected by the second reflecting surface; a fourth reflecting surface reflecting at least part of the first light rays reflected by the first reflecting surface and the second light rays reflected by the third reflecting surface; and a light exiting surface having a convex lens surface having a rear-side focal point. The fourth reflecting surface extends rearward from the rear-side focal point. A predetermined light distribution pattern is formed by superposing first and second partial light distribution patterns upon each other as a synthetic light distribution pattern.

14 Claims, 12 Drawing Sheets

(51) Int. Cl.
*F21V 7/09* (2006.01)
*F21S 8/10* (2006.01)

(52) U.S. Cl.
CPC ..... *F21S 48/1241* (2013.01); *F21S 48/1291* (2013.01); *F21S 48/1329* (2013.01); *F21S 48/145* (2013.01); *F21V 7/09* (2013.01); *F21V 13/04* (2013.01)

(58) Field of Classification Search
USPC ..... 362/516, 518, 520, 328–329
See application file for complete search history.

(56) References Cited

U.S. PATENT DOCUMENTS

2006/0239020 A1* 10/2006 Albou ..... B60Q 1/26 362/520
2008/0260328 A1* 10/2008 Epstein ..... G02B 6/0018 385/32

* cited by examiner

Fig. 4A
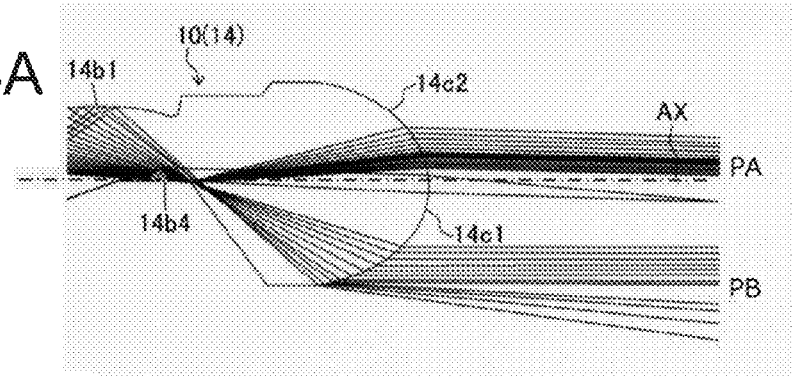
Fig. 4B
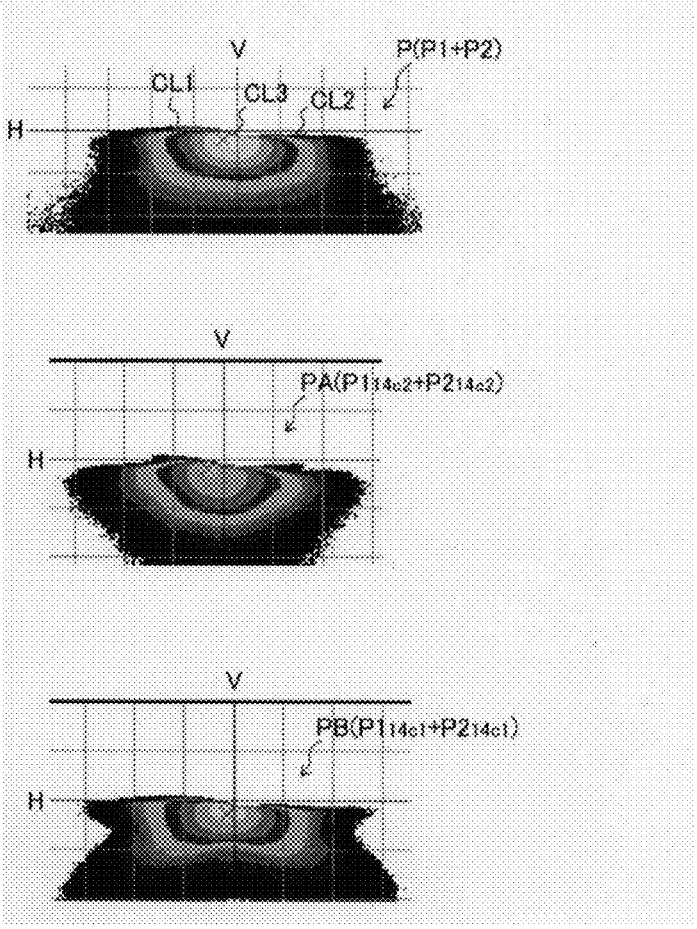
Fig. 4C
Fig. 4D

LENS MEMBER AND VEHICLE LIGHTING UNIT

This application claims the priority benefit under 35 U.S.C. §119 of Japanese Patent Application No. 2014-170208 filed on Aug. 25, 2014, which is hereby incorporated in its entirety by reference.

TECHNICAL FIELD

The presently disclosed subject matter relates to lens members and vehicle lighting units, and in particular, to a lens member to be disposed in front of a light source and a vehicle lighting unit including the same.

BACKGROUND ART

Some conventional vehicle lighting units can have a light source and a lens member disposed in front of the light source, like those disclosed in Japanese Patent No. 4047186 (or US 2004/0156209A1 corresponding thereto).

FIG. 1 is a vertical cross-sectional view illustrating a vehicle lighting unit 200 described in Japanese Patent No. 4047186.

As illustrated in FIG. 1, the vehicle lighting unit 200 includes a light source 210 having a semiconductor light emitting element, and a lens member 220 disposed in front of the light source 210. The lens member 220 can have a light incident surface 221, a first reflecting surface 222, a second reflecting surface 223, and a convex lens surface 224. The light incident surface 221 can have a semicircular shape so as to cover the light source 210 from above with the light source 210 disposed such that the light emission surface thereof faces upward. The first reflecting surface 222 can be disposed at a position located in a direction in which the light emitted from the light source 210 and entering the lens member 220 through the light incident surface 221 travels. The second reflecting surface 223 can extend from the lower end edge of the first reflecting surface 222 forward.

The vehicle lighting unit 200 with the above configuration can have the following problems.

Since the first and second reflecting surfaces 222 and 223 can be formed by deposited metal applied on the surface of the lens member 220 to be a reflecting surface having a reflectance of about 95% at maximum, the reflection loss (light loss) due to the deposited metal reflecting surfaces 222 and 223 can occur, thereby reducing the light utilization efficiency. In addition, the facilities, additional process, metal material, etc. for metal deposition are required, resulting in cost increase. There also arises another problem in that the deposited metal reflecting surfaces 222 and 223 (reflecting films) have a reduced durability.

SUMMARY

The presently disclosed subject matter was devised in view of these and other problems and features in association with the conventional art. According to an aspect of the presently disclosed subject matter, a lens member and a vehicle lighting unit including the same that can eliminate the metal deposition process which may cause cost increase, and can also suppress the reflection loss (light loss).

According to another aspect of the presently disclosed subject matter, a lens member, to be disposed in front of a light source, can be configured to include a front end portion and a rear end portion, and to form a predetermined light distribution pattern including a cut-off line at an upper edge thereof by causing light rays emitted from the light source and entering the lens member to exit through the front end portion for irradiation. The lens member can include: an incident portion configured to allow the light rays from the light source to enter the lens member while dividing the entering light rays into first light rays that travel obliquely upward and forward and second light rays that travel obliquely upward and rearward; a first reflecting surface configured to internally reflect the first light rays; a second reflecting surface configured to internally reflect the second light rays; a third reflecting surface configured to internally reflect the second light rays that have been internally reflected by the second reflecting surface; a fourth reflecting surface configured to internally reflect at least part of the first light rays that have been internally reflected by the first reflecting surface and the second light rays that have been internally reflected by the third reflecting surface; and a light exiting surface disposed at the front end portion and configured to be a convex lens surface having a rear-side focal point. In the lens member with the above configuration, the fourth reflecting surface can be configured to be a reflecting surface having a front end edge and extending rearward from a position at or near the rear-side focal point of the light exiting surface. The incident portion, the first reflecting surface, the fourth reflecting surface, and the light exiting surface can constitute a first optical system configured to form a first partial light distribution pattern including a cut-off line at an upper end edge thereof defined by the front end edge of the fourth reflecting surface, the first partial light distribution pattern being formed by irradiating, forward through the light exiting surface, light rays not shielded by the fourth reflecting surface and light rays internally reflected by the fourth reflecting surface out of the first light rays having entered the lens member through the incident portion and been internally reflected by the first reflecting surface. The incident portion, the second reflecting surface, the third reflecting surface, the fourth reflecting surface, and the light exiting surface can constitute a second optical system configured to form a second partial light distribution pattern including a cut-off line at an upper end edge thereof defined by the front end edge of the fourth reflecting surface, the second partial light distribution pattern being formed by irradiating, forward through the light exiting surface, light not shielded by the fourth reflecting surface and light rays internally reflected by the fourth reflecting surface out of the second light rays having entered the lens member through the incident portion and been internally reflected by the second reflecting surface and the third reflecting surface in order. The predetermined light distribution pattern can be formed by superposing the first partial light distribution pattern and the second partial light distribution pattern upon each other as a synthetic light distribution pattern.

With the use of the above-mentioned configuration, there can be provided a lens member that can eliminate the metal deposition process which may cause cost increase, and can also suppress the reflection loss (light loss).

This is because the provision of the incident portion configured to allow the light rays from the light source to enter the lens member while dividing the entering light rays into the first light rays that travel obliquely upward and forward and the second light rays that travel obliquely upward and rearward; the first reflecting surface configured to internally reflect the first light rays ("internally reflect" means "totally reflect" with the theoretical reflectance of 100%); the second reflecting surface configured to internally reflect the second light rays; the third reflecting surface configured to internally reflect the second light rays that have been internally reflected by the second reflecting surface; and the fourth reflecting surface configured to internally reflect at least part of the first light rays that have been internally reflected by the first reflecting surface and the second light rays that have been internally reflected by the third reflecting surface.

In the lens member with the above configuration, the incident portion can include a front incident surface and a rear incident surface, and the front incident surface can have a rear end edge and the rear incident surface can have a front end edge so that the rear end edge and the front end edge are connected to each other to take a V shape opened toward the light source to surround the light source while the connected front and rear incident surfaces are disposed in front of the light source, so that the light rays emitted from the light source can be incident on the front incident surface as the first light rays and on the rear incident surface as the second light rays.

With the use of the above-mentioned configuration, the action of the front and rear incident surfaces can divide the entering light rays into the first light rays that have entered the lens member through the front incident surface and travel obliquely upward and forward and the second light rays that have entered the lens member through the rear incident surface and travel obliquely upward and rearward.

In the lens member with the above configuration, the third reflecting surface can be disposed in a space between a first light path in which the first light rays travel and a second light path in which the second light rays travel so that the first light rays and the second light rays having entered the lens member through the incident portion are not directly incident on the third reflecting surface.

With the use of the above-mentioned configuration, it is possible to prevent the first light rays and the second light rays from being directly incident on the third reflecting surface and becoming uncontrolled light rays (such as glare light).

In the lens member with the above configuration, the first reflecting surface can be configured to internally reflect and converge the first light rays at or near the rear-side focal point of the light exiting surface with respect to a vertical direction.

With the use of the above-mentioned configuration, it is possible to form the predetermined light distribution pattern with excellent far-side visibility by means of relatively high light intensity near the cut-off line.

In the lens member with the above configuration, the first reflecting surface can be formed by an ellipsoidal reflecting surface configured to have a first focal point disposed at or near the rear-side focal point of the light exiting surface and a second focal point disposed at or near a virtual focal point that is an intersection where the first light rays assumed to travel in a reverse direction intersect with each other.

With the use of the above-mentioned configuration, it is possible to form the predetermined light distribution pattern with excellent far-side visibility by means of relatively high light intensity near the cut-off line.

In the lens member with the above configuration, the second reflecting surface can be configured to internally reflect the second light rays to direct the internally reflected second light rays to the third reflecting surface, and the third reflecting surface can be configured to internally reflect the second light rays having been internally reflected by the second reflecting surface to converge the internally reflected second light rays to a position at or near the rear-side focal point of the light exiting surface with respect to the vertical direction.

With the use of the above-mentioned configuration, it is possible to form the predetermined light distribution pattern with excellent far-side visibility by means of relatively high light intensity near the cut-off line.

In the lens member with the above configuration, the second reflecting surface can be a reflecting surface in a hyperbolic shape having two focal points, being one focal point disposed at or near a virtual focal point that is an intersection where the second light rays assumed to travel in a reverse direction intersect with each other and the other focal point disposed below the light source, and the third reflecting surface can be a reflecting surface in an ellipsoidal shape having a first focal point disposed at or near the rear-side focal point of the light exiting surface and a second focal point disposed at or near the other focal point of the second reflecting surface.

With the use of the above-mentioned configuration, it is possible to form the predetermined light distribution pattern with excellent far-side visibility by means of relatively high light intensity near the cut-off line.

According to still another aspect of the presently disclosed subject matter, a vehicle lighting unit can include the lens member according to any of the above configurations and the light source.

BRIEF DESCRIPTION OF DRAWINGS

These and other characteristics, features, and advantages of the presently disclosed subject matter will become clear from the following description with reference to the accompanying drawings, wherein:

FIG. 4A is a vertical cross-sectional view illustrating the state of light rays that are emitted from a light source 12, pass through a lens member 14, and exit from a light exiting surface 14*c* (including a lower surface 14*c*1 below a reference axis AX and an upper surface 14*c*2 above the reference axis AX), FIG. 4B is a diagram illustrating an example of a low beam light distribution pattern P formed by the vehicle lighting unit 10 (lens member 14) on a virtual vertical screen assumed to be disposed at a distance of 25 m away from and in front of a vehicle body, FIG. 4C is a diagram illustrating an example of an upper face light distribution pattern ($P1_{14c2}$+$P2_{14c2}$), and FIG. 4D is a diagram illustrating an example of a lower face light distribution pattern ($P1_{14c1}$+$P2_{14c1}$);

DESCRIPTION OF EXEMPLARY EMBODIMENTS

A description will now be made below to a lens member and a vehicle lighting unit of the presently disclosed subject matter with reference to the accompanying drawings in accordance with exemplary embodiments.

Figure 1:
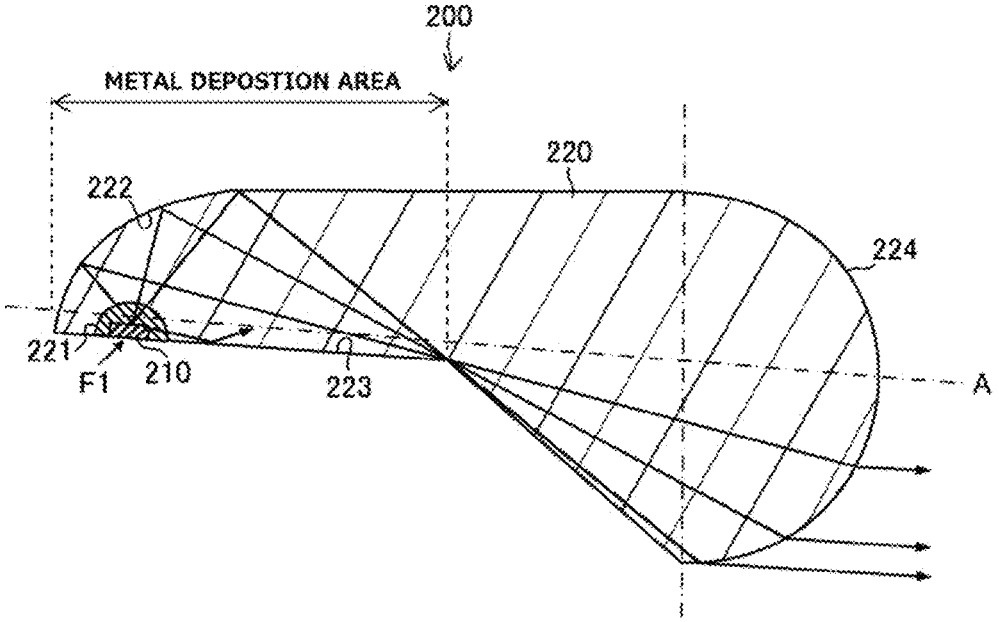
Fig. 1 Conventional Art
FIG. 1 is a vertical cross-sectional view illustrating a vehicle lighting unit 200 disclosed in Japanese Patent No. 4047186.
Figure 2:
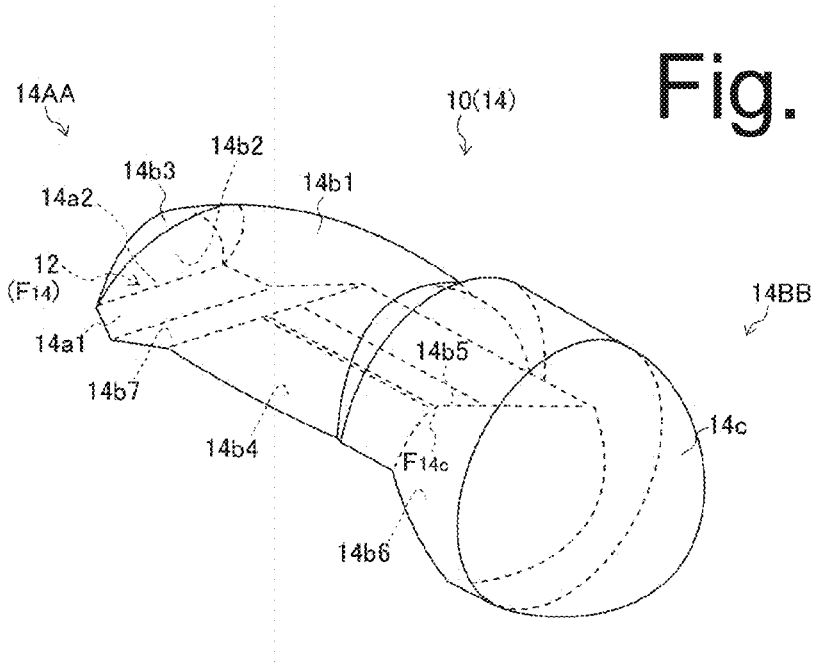
FIG. 2 is a schematic perspective view illustrating a vehicle lighting unit 10 made in accordance with principles of the presently disclosed subject matter.

In the description, the directions are described on the supposition that the light illumination direction is forward and, as illustrated in FIG. 2, etc., the lens member is disposed above the light source.

Figure 3:
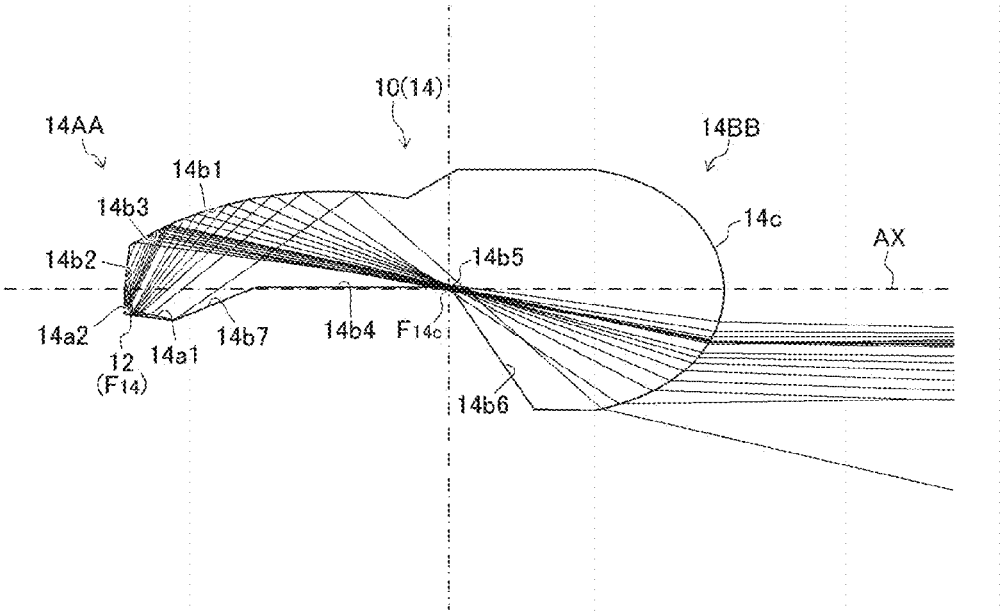
FIG. 3 is a vertical cross-sectional view illustrating the vehicle lighting unit 10 in FIG. 2.

FIG. 2 is a schematic perspective view illustrating a vehicle lighting unit 10 made in accordance with principles of the presently disclosed subject matter as a first exemplary embodiment, and FIG. 3 is a vertical cross-sectional view illustrating the vehicle lighting unit 10 in FIG. 2. FIG. 4B is a diagram illustrating an example of a low beam light distribution pattern P formed by the vehicle lighting unit 10 (lens member 14) on a virtual vertical screen assumed to be disposed at a distance of 25 m away from and in front of a vehicle body.

As illustrated in FIGS. 2 and 3, the vehicle lighting unit 10 according to the present exemplary embodiment can include a light source 12 and a lens member 14 disposed in front of the light source 12. As illustrated in FIG. 4B, the vehicle lighting unit 10 can form the low beam light distribution pattern P including cut-off lines CL1 to CL3 at its upper edge.

Figure 5:
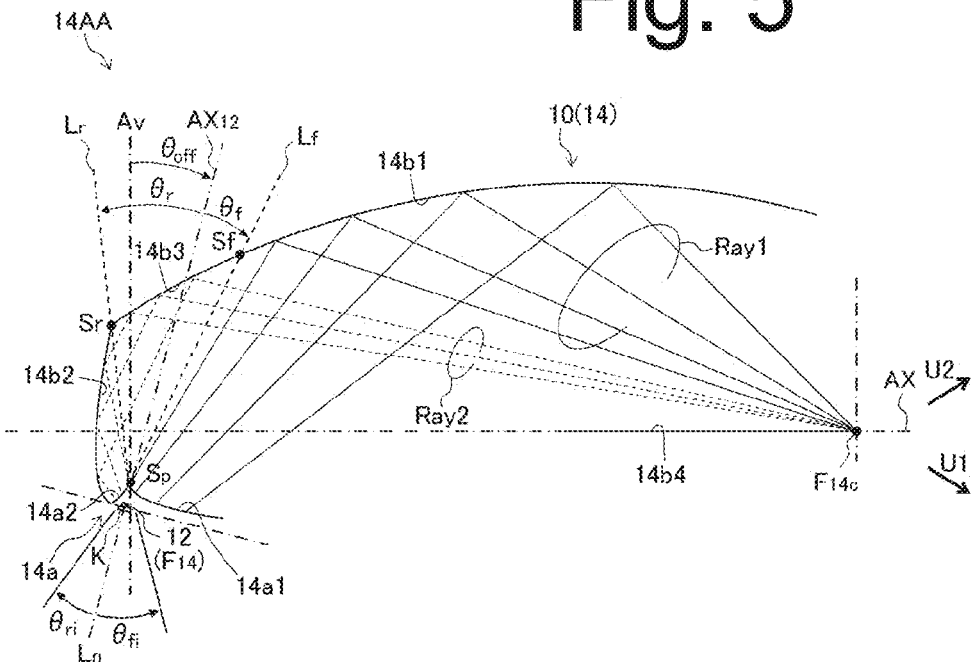
FIG. 5 is a vertical cross-sectional view illustrating an essential part of the optical system of the vehicle lighting unit 10 of FIG. 2.

FIG. 5 is a vertical cross-sectional view illustrating an essential part of the optical system of the vehicle lighting unit 10 of FIG. 2.

The light source 12 can be a semiconductor light emitting element, such as a white LD, mounted on a metal substrate K. Of course, the light source 12 may be selected from any other light sources such as a white LED, and the like. The number of the light source 12 can be one or greater.

Specifically, the white LD light source 12 can be configured to include a laser diode (LD) emitting blue laser light (for example, of which wavelength is 450 nm), and a wavelength conversion member configured to receive laser light from the LD and convert part thereof to light with different wavelength. The wavelength conversion member can be a rectangular plate-shaped phosphor (for example, 0.4 mm×0.8 mm) that can be excited by the blue laser light and emit yellow light. The white LD light source with the above configuration can emit pseud white light by mixing the original blue laser light passing through the wavelength conversion member and yellow light emitted by the excited wavelength conversion member.

The lens body 14 can have a light source point $F_{14}$ (reference point in terms of optical designing), and the light source 12 can be disposed at or near the light source point $F_{14}$ while its light emission surface faces upward. The light source 12 can have an optical axis $AX_{12}$, and as illustrated in FIG. 5, can pass an incident crossing point Sp where a front incident surface 14*a*1 and a rear incident surface 14*a*2 of the lens member 14 are connected to each other. Further, the optical axis $AX_{12}$ can be inclined with respect to a vertical line Av, though it may be made coincident with the vertical line Av.

When the light source is a semiconductor light emitting element, such as a white LD light source, the directional characteristics of light rays emitted from the light emission surface of the light source 12 can be a Lambertian distribution and represented by $I(\theta)=I_0\times\cos\theta$, which can show the degree of spreading light rays emitted from the light source 12. The $I(\theta)$ in the equation represents the intensity of light emitted from the light source 12 in a direction inclined by an angle $\theta$ with respect to the optical axis $AX_{12}$, and the $I_0$ represents the intensity on the optical axis $AX_{12}$. The employed light source 12 can have a maximum light intensity on the optical axis $AX_{12}$ ($\theta$=0 (zero)).

As illustrated in FIGS. 2 and 3, the lens member 14 can be disposed in front of the light source 12, and can include a rear end portion 14AA and a front end portion 14BB. The light rays emitted from the light source 12 can enter the inside of the lens member 14 and exit through the front end portion 14BB (light exiting surface 14*c*) so that the lens member 14 can project light forward to form the low beam light distribution pattern P including the upper edge cut-off lines CL1 to CL3, as illustrated in FIG. 4B. Specifically, the lens member 14 can include: an incident portion 14*a* configured to allow the light rays from the light source 12 to enter the lens member 14 while dividing the entering light rays into first light rays Ray1 that travel obliquely upward and forward and second light rays Ray2 that travel obliquely upward and rearward; a first reflecting surface 14*b*1 configured to internally reflect the first light rays Ray1; a second reflecting surface 14*b*2 configured to internally reflect the second light rays Ray2; a third reflecting surface 14*b*3 configured to internally reflect the second light rays Ray2 that have been internally reflected by the second reflecting surface 14*b*2; a fourth reflecting surface 14*b*4 configured to internally reflect at least part of the first light rays Ray1 that have been internally reflected by the first reflecting surface 14*b*1 and the second light rays Ray2 that have been internally reflected by the third reflecting surface 14*b*3; and a light exiting surface 14*c* disposed at the front end portion 14BB and configured to be a convex lens surface having a rear-side focal point $F_{14c}$. The lens member 14 can be formed from a transparent material such as a transparent resin like a polycarbonate resin, an acrylic resin, etc., a glass material, etc.

The lens member 14 can have a first optical system, to be described later, configured to form a first partial light distribution pattern P1, and a second optical system, also to be described later, configured to form a second partial light distribution pattern P2, and the first and second partial light distribution patterns P1 and P2 can be superimposed upon each other to form the low beam light distribution pattern P as illustrated in FIG. 4B.

A description will now be given of the detailed configuration of the lens member 14. The lens member 14, as illustrated in FIG. 5, can include in the rear end portion 14AA: the incident portion 14*a* configured to allow the light (light ray group from the light source point $F_{14}$) from the light source 12 to enter the lens member 14 while dividing (splitting) the entering light into first light rays Ray 1 (first light ray group) that can travel obliquely upward and forward and second light rays Ray2 (second light ray group) that can travel obliquely upward and rearward; the first reflecting surface 14*b* 1 configured to internally (totally) reflect the first light rays Ray1 having entered the lens member 14; the second reflecting surface 14*b*2 configured to internally (totally) reflect the second light rays Ray2 having entered the lens member 14; the third reflecting surface 14*b*3 configured to internally (totally) reflect the second light rays Ray2 that has been internally reflected by the second reflecting surface 14*b*2; and the fourth reflecting surface 14*b*4 configured to internally (totally) reflect at least part of the first light rays Ray1 that have been internally reflected by the first reflecting surface 14*b*1 and the second light rays Ray2 that have been internally reflected by the third reflecting surface 14*b*3.

The lens member 14 can include the light exiting surface 14*c* disposed at the front end portion 14BB and configured to be a convex lens surface having a rear-side focal point $F_{14c}$. Note that, for easy understanding, a description will be given on the assumption that the light rays are emitted from the light source point $F_{14}$ (reference point in terms of optical designing) of the lens body 14. Further, in an actual vehicular lamp, light rays emitted near the light source point $F_{14}$ are present due to the light source 12 being located near the light source point $F_{14}$ with the light emission surface facing upward.

Next, the first optical system configured to form the first partial light distribution pattern P1 (see FIG. 4B) will be described.

As illustrated in FIGS. 3 and 5, the first optical system can be constituted by the incident portion 14*a* (the front incident surface 14*a*1), the first reflecting surface 14*b*1, the fourth reflecting surface 14*b*4, and the light exiting surface 14*c*. Specifically, the first light rays Ray1 having entered the lens member 14 through the incident portion 14*a* (the front incident surface 14*a*1) can be internally reflected by the first reflecting surface 14*b*1, and part of the first light rays Ray1 can be shielded by the fourth reflecting surface 14*b*4. Another part of the right rays Ray1 not shielded by the fourth reflecting surface 14*b*4 and light rays internally reflected by the fourth reflecting surface 14*b*4 can exit through the light exiting surface 14*c* to be projected forward. The thus projected light rays can form the first partial light distribution pattern P1, as illustrated in FIG. 4B, including the upper end edge cut-off lines CL1 to CL3 that are defined by a front end edge 14*b*5 of the fourth reflecting surface 14*b*4. Note that the lens body 14 constituting the first optical system is disposed in the air and thus, the first reflecting surface 14*b*1 and the fourth reflecting surface 14*b*4 can be formed as a reflecting surface that can totally reflect light by means of an interface with the air.

As illustrated in FIG. 4B, the first partial light distribution pattern P1 can be formed by superimposing the upper face light distribution pattern $P1_{14c2}$ upon the lower face light distribution pattern $P1_{14c1}$ as illustrated in FIGS. 4C and 4D.

As illustrated in FIG. 5, the incident portion 14*a* can include the front incident surface 14*a*1 and the rear incident surface 14*a*2, which can be connected to each other at its rear end edge and its front end edge, so as to surround the light source 12 from above. Namely, the front incident surface 14*a*1 and the rear incident surface 14*a*2 can form a surface with a V-letter cross section (or in a roof top shape) in front of the light source 12. The straight line connecting the light source point $F_{14}$ and the incident crossing point Sp where the front incident surface 14*a*1 and the rear incident surface 14*a*2 are connected to each other can be inclined with respect to the vertical line Av. As a matter of course, the straight line connecting the light source point $F_{14}$ and the incident crossing point Sp may be coincident with the vertical line Av.

The light source 12 can have the optical axis $AX_{12}$, and as illustrated in FIG. 5, can pass the incident crossing point Sp where the front incident surface 14*a*1 and the rear incident surface 14*a*2 of the lens member 14 are connected to each other. As illustrated in its vertical cross-sectional view, the front incident surface 14*a*1 can have a surface through which part of light rays emitted from the light source 12 can enter the lens member 14 while being refracted. Here, the part of light rays entering the front incident surface 14*a*1 can be those emitted from the light source 12 at an emission angle range of 0 degrees to 75 degrees with respect to its optical axis $AX_{12}$, for example. The surface shape of the front incident surface 14*a*1 can be configured such that the light rays that are emitted from the light source 12 and enter the lens member 14 can become the first light rays Ray1 travelling obliquely upward and forward due to refraction (or convergence). Specifically, the first light rays Ray1 can be a light ray group travelling in a direction inclined by a forward splitting angle of $\theta_f$ or greater with respect to the optical axis $AX_{12}$ of the light source 12.

Specifically, the front incident surface 14*a*1 can be shaped in a substantially flat plane while inclined obliquely downward and forward so as to surround the light source 12 from above on the front side of the optical axis $AX_{12}$ of the light source 12.

Figure 6:
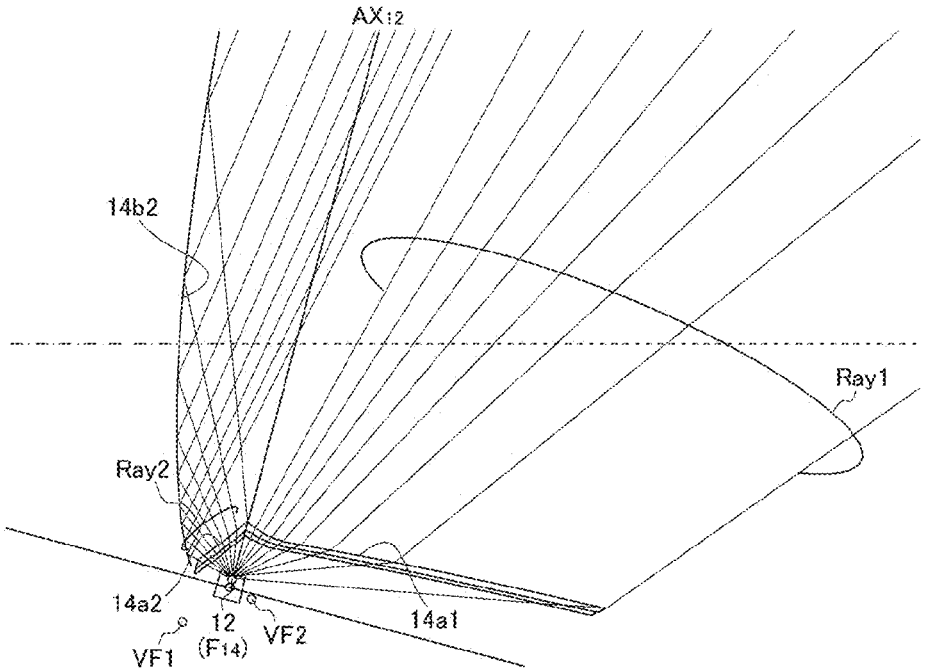
FIG. 6 is a diagram illustrating virtual focal points VF1 and VF2.

The light rays having entered the lens member 14 through the front incident surface 14*a*1 can become the first light rays Ray1 to travel as if they have been emitted from a virtual focal point VF1 as illustrated in FIG. 6 due to refraction (or convergence) with respect to the vertical direction. The virtual focal point VF1 can be defined as an intersection where the first light rays Ray1 (the first light ray group) assumed to travel in a reverse direction intersect with each other.

The smaller the inclined angle $\theta_{fi}$ of the front incident surface 14*a*1 becomes, the greater the forward splitting angle $\theta_f$ can be, whereas the greater the inclined angle $\theta_{fi}$ of the front incident surface 14*a*1 becomes, the smaller the forward splitting angle $\theta_f$ can be.

The front incident surface 14*a*1 in its horizontal cross section can have a surface shape configured such that the low beam light distribution pattern P can have a desired horizontal light intensity distribution.

Figure 7:
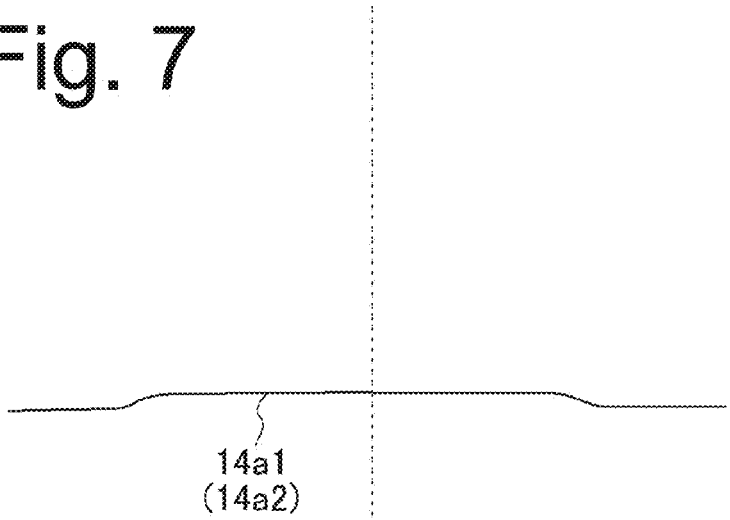
FIG. 7 is a horizontal cross-sectional view illustrating a front incident surface 14*a*1 (also a rear incident surface 14*a*2)

Specifically, the front incident surface 14*a*1 (horizontal cross section) can have a shape in a combination of straight lines and curved lines, as illustrated in FIG. 7, so that the light rays emitted from the light source 12 can enter the inside of the lens member 14 with high efficiency. This shape is not limitative, and the horizontal cross section of the front incident surface 14*a*1 can be a recessed arc shape so as to surround the light source 12 from above.

The first reflecting surface 14*b*1 can be a surface configured to internally (totally) reflect the first light rays Ray1 having entered through the front incident surface 14*a*1, and is not formed by metal vapor deposition.

The first reflecting surface 14*b*1 in its vertical cross section can have a surface shape configured to internally reflect the first light rays Ray1 to converge the same at or near the rear-side focal point $F_{14c}$ of the light exiting surface 14*c* with respect to the vertical direction.

Figure 8:
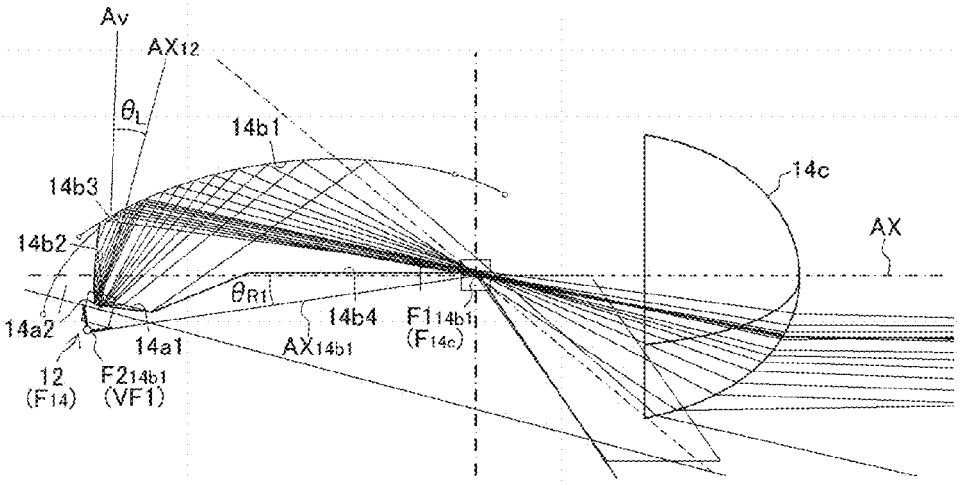
FIG. 8 is a vertical cross-sectional view illustrating a first reflecting surface 14*b*1.

Specifically, the first reflecting surface 14*b*1 in its vertical cross section as illustrated in FIG. 8 can be designed to be an ellipsoidal reflecting surface or a similar free curved surface, having a first focal point $F1_{14b1}$ at or near the rear-side focal point $F_{14c}$ of the light exiting surface 14*c* and a second focal point $F2_{14b1}$ at or near the virtual focal point VF1 that is the intersection where the first light rays Ray1 (the first light ray group) assumed to travel in a reverse direction intersect with each other. The first reflecting surface 14*b*1 with this configuration can internally reflect the first light rays Ray1.

Note that the reflecting surface configured to internally reflect the first light rays Ray1 out of the ellipsoidal reflecting surface may vary depending on the material (refractive index) of the lens member 14, the ellipsoidal shape (the inclined angle $\theta_{R1}$ and the length of the long axis $AX_{14b1}$ of the ellipsoidal shape with respect to a reference axis AX extending in the vehicle front-to-rear direction), the inclined angle $\theta_L$ of the optical axis $AX_{12}$ of the light source 12 with respect to the vertical line Av, the shape of the front incident surface 14*a*1 (the front splitting angle $\theta_f$, the degree of refraction (convergence) of the first light rays Ray1, etc.), and therefore, it is difficult to define it with concrete numerical values. However, recent simulation software can find out the reflecting surface (namely, the first reflecting surface 14*b*1) configured to internally reflect the first light rays Ray1 out of the ellipsoidal reflecting surface by changing (adjusting) at least one factor such as the material (refractive index) of the lens member 14, the ellipsoidal shape (the inclined angle $\theta_{R1}$ and the length of the long axis $AX_{14b1}$ of the ellipsoidal shape with respect to an reference axis AX extending in the vehicle front-to-rear direction), the inclined angle $\theta_L$ of the optical axis $AX_{12}$ of the light source 12 with respect to the vertical line Av, the shape of the front incident surface 14*a*1 (the front splitting angle $\theta_f$, the degree of refraction (convergence) of the first light rays Ray1, etc.), etc., and, for every change, confirming the optical path for the first light rays Ray1 (or the light ray group from the light source point $F_{14}$) having entered the lens member 14 through the front incident surface 14*a*1.

Figure 9:
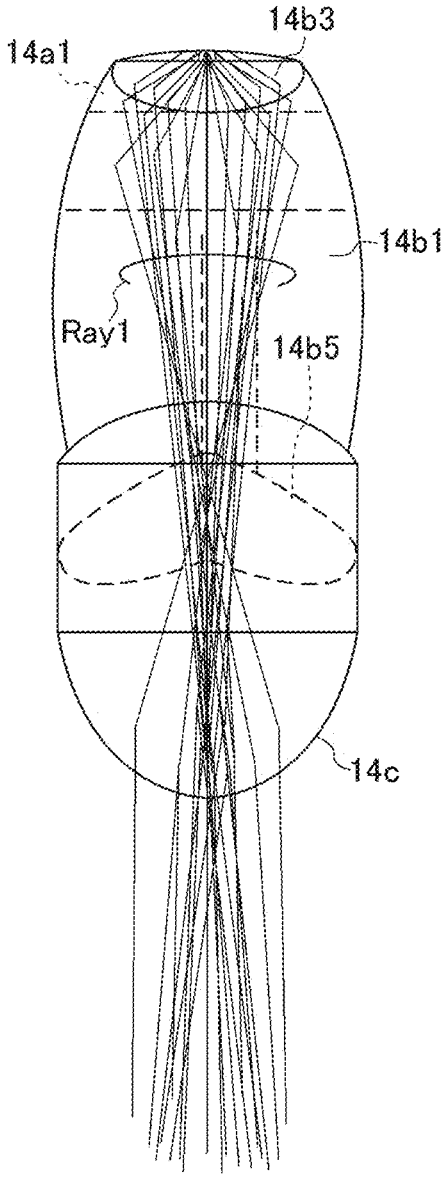
FIG. 9 is a diagram (top view) illustrating optical paths along which first light rays Ray1 having been internally reflected by the first reflecting surface 14*b*1 travel.

The first reflecting surface 14*b*1 in its horizontal cross section can be configured such that the low beam light distribution pattern P can have a desired horizontal light intensity distribution. Specifically, for example, the first reflecting surface 14*b*1 in its horizontal cross section can be a reflecting surface based on a basic ellipsoidal shape so as to obtain the low beam light distribution pattern P with a desired horizontal light intensity distribution. FIG. 9 illustrates the optical path along which the first light rays Ray1 having been internally reflected by the first reflecting surface 14*b*1 can travel.

Figure 10A:
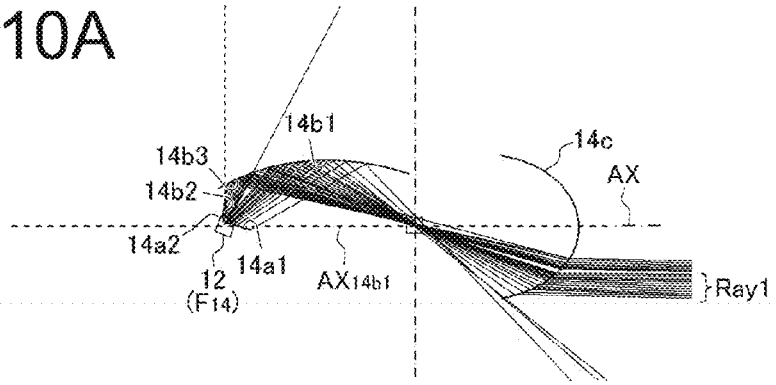
FIG. 10A is a diagram illustrating an example where a long axis $AX_{14b1}$ of the first reflecting surface 14*b*1 (ellipsoidal shape) is made coincide with the reference axis AX.

The long axis $AX_{14b1}$ of the first reflecting surface 14*b*1 in the ellipsoidal shape as illustrated in FIG. 8 can be inclined with respect to the reference axis AX within a range in which the second light rays Ray2 having been internally reflected by the third reflecting surface 14*b*3 are not shielded, although the long axis $AX_{14b1}$ of the first reflecting surface 14*b*1 may be coincident with the reference axis AX (see FIG. 10A).

When the long axis $AX_{14b1}$ of the first reflecting surface 14*b*1 in the ellipsoidal shape as illustrated in FIG. 8 is inclined with respect to the reference axis AX (see FIGS. 10B and 10C), the first light rays Ray1 passing near the center of the light exiting surface 14*c* can be increased as compared with the case where the long axis $AX_{14b1}$ of the first reflecting surface 14*b*1 is not inclined with respect to the reference axis AX (see FIG. 10A). Consequently, the light incident efficiency of the first light rays Ray1 having been internally reflected by the first reflecting surface 14*b*1 to the light exiting surface 14*c* can be improved. Furthermore, any Fresnel reflection loss when the first light rays Ray1 exit through the light exiting surface 14*c* can be suppressed.

Figure 10B:
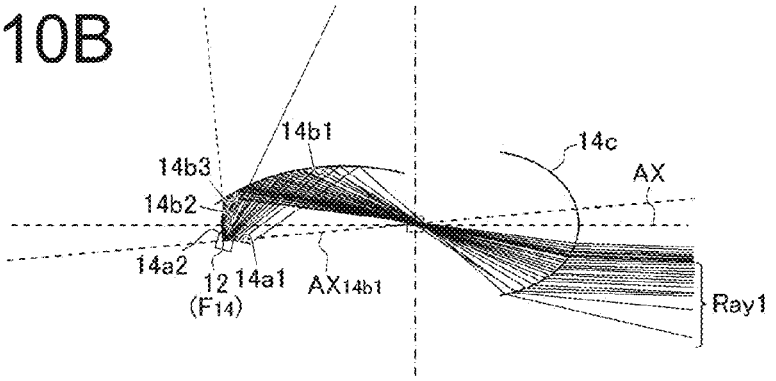
FIG. 10B is a diagram illustrating an example where the long axis $AX_{14b1}$ of the first reflecting surface 14*b*1 (ellipsoidal shape) is made inclined with respect to the reference axis AX by 5 degrees.
Figure 10C:
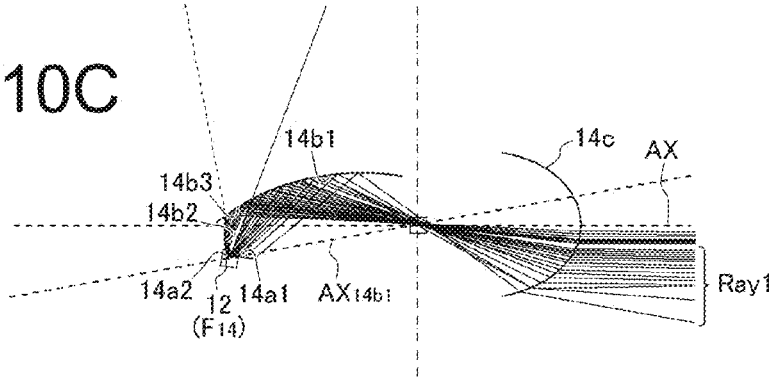
FIG. 10C is a diagram illustrating an example where the long axis $AX_{14b1}$ of the first reflecting surface 14*b*1 (ellipsoidal shape) is made inclined with respect to the reference axis AX by 10 degrees.

FIG. 10A is a diagram illustrating an example where the long axis $AX_{14b1}$ of the first reflecting surface 14*b*1 in the ellipsoidal shape is made coincide with the reference axis AX, FIG. 10B is a diagram illustrating an example where the long axis $AX_{14b1}$ of the first reflecting surface 14*b*1 in the ellipsoidal shape is made inclined with respect to the reference axis AX by 5 degrees, and FIG. 10C is a diagram illustrating an example where the long axis $AX_{14b1}$ of the first reflecting surface 14*b*1 in the ellipsoidal shape is made inclined with respect to the reference axis AX by 10 degrees.

The fourth reflecting surface 14*b*4 can be configured to internally (totally) reflect at least part of the first light rays Ray1 having been internally reflected by the front incident surface 14*b*1 (and also the second light rays Ray2 having been internally reflected by the third reflecting surface 14*b*3) and is not formed by metal vapor deposition. Specifically, since the light source 12 can be disposed at or near the light source point $F_{14}$ (reference point in terms of optical designing) while the light emission surface thereof faces upward, there are light rays near the light source point $F_{14}$. Thus, the light rays including at and near the light source point $F_{14}$ can become the first light rays Ray1 . Such first light rays Ray1 entering the lens body 14 can be internally reflected by the first reflecting surface 14*b*1 and part thereof can be internally reflected by the fourth reflecting surface 14*b*4. In the same manner, the second light rays Ray2 emitted at and near the light source point $F_{14}$ and entering the lens body 14 can be internally reflected by the second and third reflecting surfaces 14*b*2 and 14*b*3 and part thereof can be internally reflected by the fourth reflecting surface 14*b*4.

Figure 11:
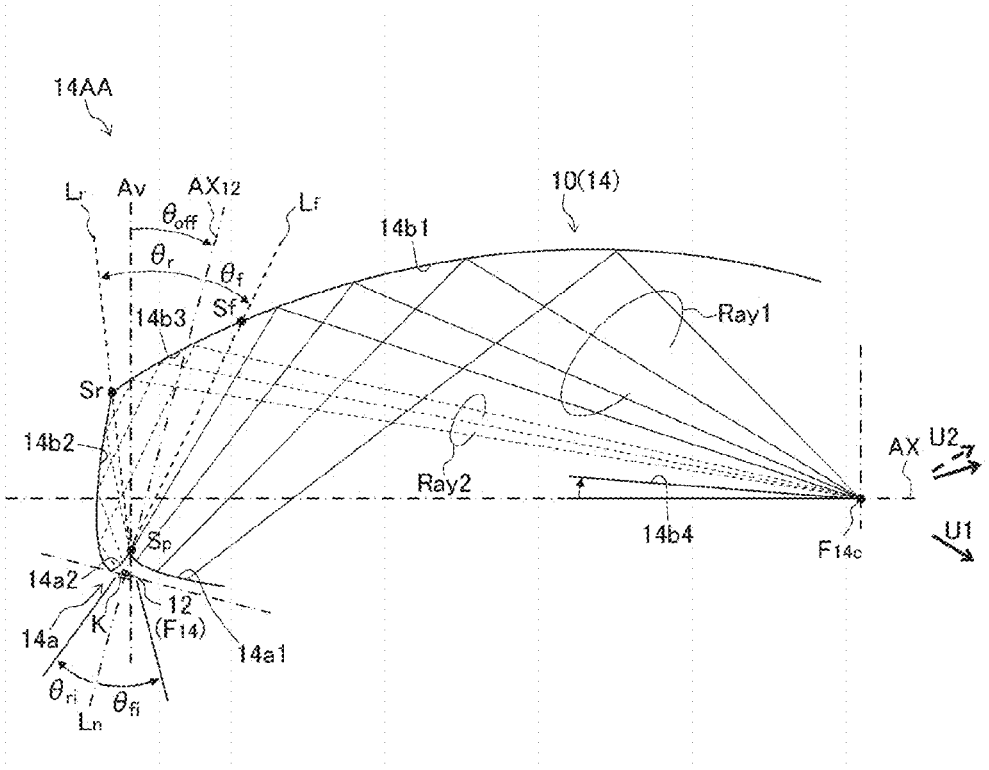
FIG. 11 is a diagram illustrating an example of a fourth reflecting surface 14*b*4 inclined with respect to a horizontal plane.
Figure 12A:
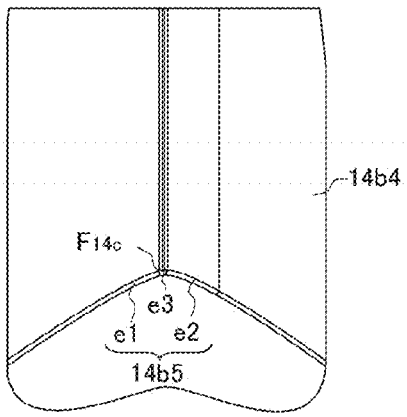
FIGS. 12A, 12B, 12C, and 12D are a top view, a front view, a perspective view, and a side view of the fourth reflecting surface 14*b*4, respectively.
Figure 12C:
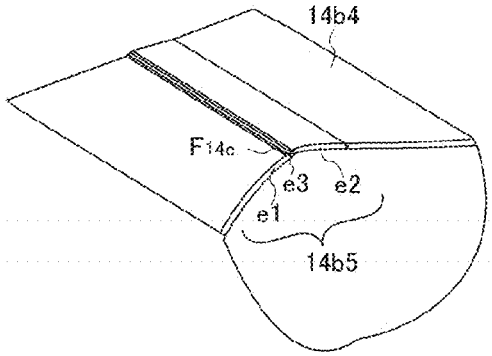
Figure 12B:
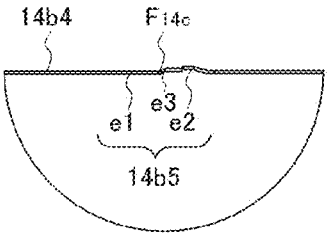
Figure 12D:
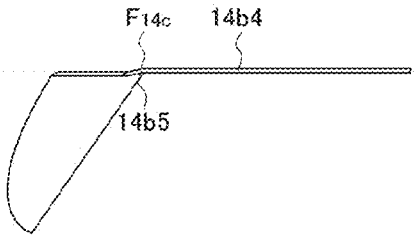

The fourth reflecting surface 14*b*4 can be configured to be a planar reflecting surface extending rearward in the horizontal direction from a position at or near the rear-side focal point $F_{14c}$ of the light exiting surface 14*c* (although the fourth reflecting surface 14*b*4 may be configured to be a planar reflecting surface inclined with respect to a horizontal plane within a range in which the second light rays Ray2 having been internally reflected by the third reflecting surface 14*b*3 are not shielded, as illustrated in FIG. 11). Since the rear-side focal point F14C is positioned forward of the fourth reflecting surface 14*b*4, the light rays emitted just from the light source point $F_{14}$ can travel within the lens body 14 without being reflected by the fourth reflecting surface 14*b*4 while remaining parts of light rays emitted near the light source point $F_{14}$ can be incident on the fourth reflecting surface 14*b*4 or pass through the front side of the same. By doing so, the first light rays Ray 1 (and the second light rays Ray2) having been internally reflected by the fourth reflecting surface 14*b*4 can be controlled to travel in a downward direction, thereby increasing the amount of the first light rays Ray1 (and the second light rays Ray2) passing at or near the center of the light exiting surface 14*c*. Consequently, the light incident efficiency of the first light rays Ray1 (and the second light rays Ray2) having been internally reflected by the fourth reflecting surface 14*b*4 to the light exiting surface 14*c* can be improved. Furthermore, any Fresnel reflection loss when the first light rays Ray1 (and the second light rays Ray2) exit through the light exiting surface 14*c* can be suppressed.

From the viewpoint of forming clearer cut-off lines CL1 to CL3 in the low beam light distribution pattern P, the front end edge 14*b*5 of the fourth reflecting surface 14*b*4 is not linear but can be formed in a recessed arc shape. FIGS. 12A, 12B, 12C, and 12D are a top view, a front view, a perspective view, and a side view of the fourth reflecting surface 14*b*4, respectively.

The front end edge 14*b*5 of the fourth reflecting surface 14*b*4 can include an edge e1 corresponding to the horizontal cut-off line CL1 on the left side, an edge e2 corresponding to the horizontal cut-off line CL2 on the right side, and an edge e3 corresponding to the inclined cut-off line CL3 connecting the left horizontal cut-off line CL1 and the right horizontal cut-off line CL2.

The edge e1 corresponding to the left horizontal cut-off CL1 can be disposed at a position lower than the edge e2 corresponding to the right horizontal cut-off line CL2 with respect to the vertical direction when a vehicle provided with the vehicle lighting unit is used in a left-hand traffic system. Further, the edge e1 corresponding to the left horizontal cut-off CL1 may be disposed at a position higher than the edge e2 corresponding to the right horizontal cut-off line CL2 with respect to the vertical direction when a vehicle provided with the vehicle lighting unit is used in a right-hand traffic system.

Part of the first light rays Ray1 that have been incident on the front incident surface 14*a*1 of the incident portion 14*a* to enter the lens member 14 and internally reflected by the first reflecting surface 14*b*1 can be shielded by the fourth reflecting surface 14*b*4. Another part (remaining part) of the first light rays Ray1 not shielded by the fourth reflecting surface 14*b*4 can exit through the lower surface 14*c*1 of the light exiting surface 14*c* below the reference axis AX to be projected forward, as illustrated in FIG. 4A. The projected light rays can thus form the lower face light distribution pattern $P1_{14c1}$ (see FIG. 4D) including the cut-off line at the upper end edge defined by the front end edge 14*b*5 of the fourth reflecting surface 14*b*4. Note that in FIG. 4A, the light distribution pattern including the light rays exiting through the lower surface 14*c*1 is denoted by PB. On the other hand, the part of the first light rays Ray1 that have been incident on the front incident surface 14*a*1 of the incident portion 14*a* to enter the lens member 14 and internally reflected by the first reflecting surface 14*b*1 can be internally reflected by the fourth reflecting surface 14*b*4 to be projected forward through the upper surface 14*c*2 of the light exiting surface 14*c* above the reference axis AX. The thus projected light rays can be directed to a road surface (see FIG. 4A). Note that in FIG. 4A, the light distribution pattern including the light rays exiting through the upper surface 14*c*2 is denoted by PA.

Note that the action of "shield(ing, ed)" means to include the case where the light rays reaching the fourth reflecting surface 14*b*4 is prevented from straightforwardly travelling while being totally reflected, compared with the case where there is no fourth reflecting surface.

Specifically, the first light rays Ray1 having been internally reflected by the fourth reflecting surface 14*b*4 can form a pattern obtained by folding the original pattern at the cut-off line as a border to be superimposed on the portion below the cut-off line, whereby the upper face light distribution pattern $P1_{14c2}$ including the cut-off line at the upper end edge defined by the front end edge 14*b*5 of the fourth reflecting surface 14*b*4 (see FIG. 4C).

The light exiting surface 14*c* can be configured as a convex lens surface projected forward and having the rear-side focal point $F_{14C}$ at or near the front end edge 14*b*5 of the fourth reflecting surface 14*b*4 (at or near the horizontal center of the front end edge 14*b*5, for example). The light exiting surface 14*c* can function as the convex lens to project the light distribution image (light source image) formed by the first light rays Ray1 having been internally reflected by the first reflecting surface 14*b*1 (and the second light rays Ray2 having been internally reflected by the third reflecting surface 14*b*3) at or near the rear-side focal point $F_{14C}$ of the light exiting surface 14*c* while inverting the image, thereby forming the first partial light distribution pattern P1 (and the second partial light distribution pattern P2).

Between the front end edge 14*b*5 of the fourth reflecting surface 14*b*4 and the lower end edge of the light exiting surface 14*c*, there can be formed a curved surface 14*b*6 inclined obliquely forward and downward, as illustrated in FIG. 3, etc. The surface 14*b*6 may not have optical function, and can serve simply as a connecting surface therebetween. Furthermore, between the rear end edge of the fourth reflecting surface 14*b*4 and the front end edge of the front incident surface 14*a*1, there can be formed a planar surface 14*b*7 inclined obliquely forward and upward, as illustrated in FIG. 3, etc. The surface 14*b*7 may not have optical function, and can serve simply as a connecting surface.

The first optical system with the above configuration can superimpose the lower face light distribution pattern $P1_{14c1}$ (see FIG. 4D) on the upper face light distribution pattern $P1_{14c2}$ (see FIG. 4C) to form the first partial light distribution pattern P1.

Next, the second optical system configured to form the second partial light distribution pattern P2 (see FIG. 4B) will be described.

As illustrated in FIGS. 3 and 5, the second optical system can be constituted by the incident portion 14*a* (the rear incident surface 14*a*2), the second reflecting surface 14*b*2, the third reflecting surface 14*b*3, the fourth reflecting surface 14*b*4, and the light exiting surface 14*c*. Specifically, the second light rays Ray2 having entered the lens member 14 through the incident portion 14*a* (the rear incident surface 14*a*2) can be internally reflected by the second reflecting surface 14*b*2 and the third reflecting surface 14*b*3, and part of the second light rays Ray2 can be shielded by the fourth reflecting surface 14*b*4. Another part (remaining part) thereof not shielded by the fourth reflecting surface 14*b*4 and light rays internally reflected by the fourth reflecting surface 14*b*4 can exit through the light exiting surface 14*c* to be projected forward. The thus projected light rays can form the second partial light distribution pattern P2 including the upper end edge cut-off lines defined by the front end edge 14*b*5 of the fourth reflecting surface 14*b*4.

As illustrated in FIG. 4B, the second partial light distribution pattern P2 can be formed by superimposing the upper face light distribution pattern $P2_{14c2}$ upon the lower face light distribution pattern $P2_{14c1}$ as illustrated in FIGS. 4C and 4D.

As illustrated in its vertical cross-sectional view, the rear incident surface 14*a*2 can have a surface through which part of light rays emitted from the light source 12 can enter the lens member 14 while being refracted. Here, the part of light rays can be those emitted from the light source 12 at an emission angle range of 0 degrees to 75 degrees with respect to its optical axis $AX_{12}$. As illustrated in FIG. 5, the surface shape of the rear incident surface 14*a*2 can be configured such that the light rays that are emitted from the light source 12 and enter the lens member 14 can become the second light rays Ray2 travelling obliquely upward and rearward due to refraction (or convergence). Specifically, the second light rays Ray2 can be a light ray group travelling in a direction inclined by a rearward splitting angle of $\theta_r$ or greater with respect to the optical axis $AX_{12}$ of the light source 12.

Specifically, the rear incident surface 14*a*2 can be shaped in a substantially flat plane while inclined obliquely downward and rearward so as to surround the light source 12 from above on the rear side of the optical axis $AX_{12}$ of the light source 12.

The light rays having entered the lens member 14 through the rear incident surface 14*a*2 can become the second light rays Ray2 to travel as if they have been emitted from a virtual focal point VF2 as illustrated in FIG. 6 due to refraction (or convergence) with respect to the vertical direction. The virtual focal point VF2 can be defined as an intersection where the second light rays Ray2 (the second light ray group) assumed to travel in a reverse direction intersect with each other.

The smaller the inclined angle $\theta_{ri}$ of the rear incident surface 14*a*2 becomes, the greater the rear splitting angle $\theta_r$ can be, whereas the greater the inclined angle $\theta_{ri}$ of the rear incident surface 14*a*2 becomes, the smaller the rear splitting angle $\theta_r$ can be.

The rear incident surface 14*a*2 in its horizontal cross section can be configured such that the low beam light distribution pattern P can have a desired horizontal light intensity distribution.

Specifically, the rear incident surface 14*a*2 (horizontal cross section) can have a shape in a combination of straight lines and curved lines, as illustrated in FIG. 7, so that the light rays emitted from the light source 12 can enter the inside of the lens member 14 with high efficiency. This shape is not limitative, and the horizontal cross section of the rear incident surface 14*a*2 can be a recessed arc shape so as to surround the light source 12 from above.

The second reflecting surface 14*b*2 can be configured to internally (totally) reflect the second light rays Ray2 having entered through the rear incident surface 14*a*2, and is not formed by metal vapor deposition.

The second reflecting surface 14*b*2 in its vertical cross section can be configured to internally reflect the second light rays Ray2 to direct the same toward the third reflecting surface 14*b*3.

Figure 13:
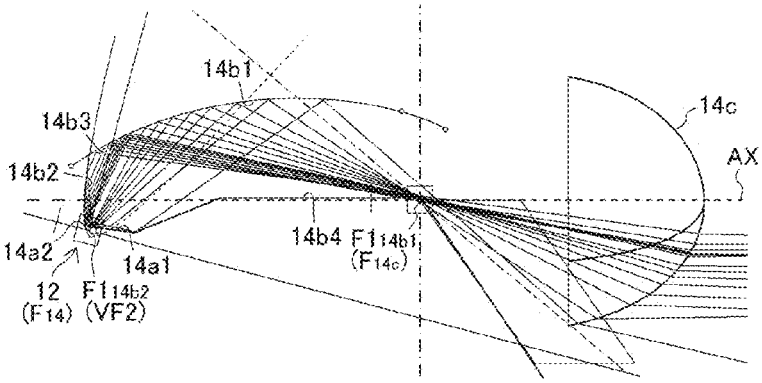
FIG. 13 is a vertical cross-sectional view illustrating a second reflecting surface 14*b*2.
Figure 13:
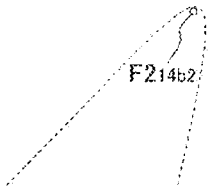

Specifically, the second reflecting surface 14*b*2 in its vertical cross section as illustrated in FIG. 13 can be designed to be a hyperbolic reflecting surface or a similar free curved surface, having one focal point $F1_{14b2}$ at or near the virtual focal point VF2 that is the intersection where the second light rays Ray2 assumed to travel in a reverse direction intersect with each other, and the other focal point $F2_{14b2}$ below the light source 12. The second reflecting surface 14*b*2 with this configuration can internally reflect the second light rays Ray2.

Note that the reflecting surface configured to internally reflect the second light rays Ray2 out of the hyperbolic reflecting surface may vary depending on the material (refractive index) of the lens member 14, the hyperbolic shape (the position of the other focal point $F2_{14b2}$), the inclined angle $\theta_L$ of the optical axis $AX_{12}$ of the light source 12 with respect to the vertical line Av, the shape of the rear incident surface 14*a*2 (the rear splitting angle $\theta_r$, the degree of refraction (convergence) of the second light rays Ray2, etc.), and therefore, it is difficult to define it with concrete numerical values. However, recent simulation software can find out the reflecting surface (namely, the second reflecting surface 14*b*2) configured to internally reflect the second light rays Ray2 out of the hyperbolic reflecting surface by changing (adjusting) at least one factor such as the material (refractive index) of the lens member 14, the hyperbolic shape (the position of the other focal point $F2_{14b2}$), the inclined angle $\theta_L$ of the optical axis $AX_{12}$ of the light source 12 with respect to the vertical line Av, the shape of the rear incident surface 14*a*2 (the rear splitting angle $\theta_r$, the degree of refraction (convergence) of the second light rays Ray2, etc.), etc., and, for every change, confirming the optical path for the second light rays Ray2 (or the light ray group from the light source point $F_{14}$) having entered the lens member 14 through the rear incident surface 14*a*2.

The light rays having entered the lens member 14 through the rear incident surface 14*a*2 can become the second light rays Ray2 and then can be internally reflected by the second reflecting surface 14*b*2 to travel as if they have been emitted from the other focal point $F2_{14b2}$ due to the geometric characteristics of the hyperboloid with respect to the vertical direction.

Figure 14A:
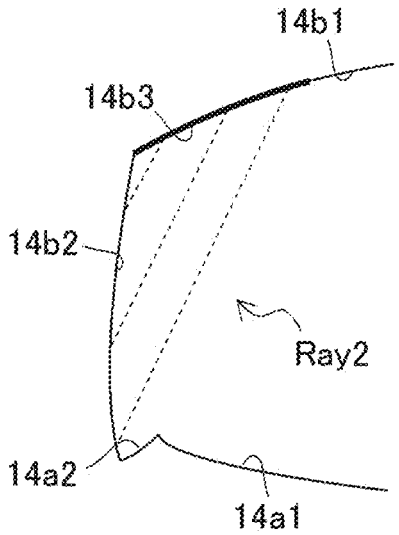
FIG. 14A is a diagram illustrating a state where second light rays Ray2 (second light ray group) having been internally reflected by the second reflecting surface 14*b*2 travel in a parallel state toward the third reflecting surface 14*b*3.
Figure 14B:
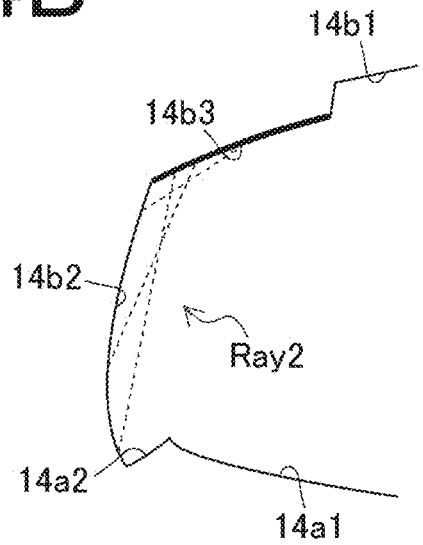
FIG. 14B is a diagram illustrating a state where the second light rays Ray2 (second light ray group) having been internally reflected by the second reflecting surface 14*b*2 travels in a crossing state toward the third reflecting surface 14*b*3.

The second reflecting surface 14*b*2 can be configured to internally reflect the second light rays Ray2 (the second light ray group) in a parallel state toward the third reflecting surface 14*b*3, as illustrated in FIG. 14A. This is because the wider angle design can be made up to the critical angle for total reflection, thereby enhancing the design degree of freedom for the third reflecting surface 14*b*3. FIG. 14B is a diagram illustrating another example of the second reflecting surface 14*b*2 configured such that the second light rays Ray2 (second light ray group) having been internally reflected by the second reflecting surface 14*b*2 travel in a crossing state toward the third reflecting surface 14*b*3.

The second reflecting surface 14*b*2 in its horizontal cross section can be configured such that the low beam light distribution pattern P can have a desired horizontal light intensity distribution.

The third reflecting surface 14*b*3 can be configured to internally (totally) reflect the second light rays Ray2 having been internally reflected by the second reflecting surface 14*b*2 and is not formed by metal vapor deposition.

The third reflecting surface can be disposed in a space (a region defined by the splitting angles $\theta_f$ and $\theta_r$ as illustrated in FIG. 5) between the first light path in which the first light rays Ray1 travel and the second light path in which the second light rays Ray2 travel so that the first light rays Ray1 and the second light rays Ray2 having entered the lens member 4 through the incident portion 14*a* (the front incident surface 14*a*1 and the rear incident surface 14*a*2) are not directly incident on the third reflecting surface 14*b*3. Specifically, The third reflecting surface can be disposed between an intersection $S_f$ and another intersection $S_r$, where the intersection $S_f$ is formed between the first reflecting surface 14*b*1 and a straight line $L_f$ defining the front splitting angle $\theta_f$ (the light rays passing nearest the incident surface intersection $S_p$ out of the light rays having entered the lens member 14 through the front incident surface 14*a*1), while the intersection $S_r$ is formed between the second reflecting surface 14b2 and a straight line $L_r$ defining the rear splitting angle $\theta_r$ (the light rays passing nearest the incident surface intersection $S_p$ out of the light rays having entered the lens member 14 through the rear incident surface 14a2). With the use of the above-mentioned configuration, it is possible to prevent the first light rays Ray1 and the second light rays Ray2 from being directly incident on the third reflecting surface 14b3 and becoming uncontrolled light rays (such as glare light).

The third reflecting surface 14b3 and the first reflecting surface 14b1 may be coupled with each other smoothly without any step therebetween as illustrated in FIG. 5, or with a step therebetween, as illustrated in FIG. 14B.

The third reflecting surface 14b3 in its vertical cross section can be configured to internally reflect the second light rays Ray2 that have been internally reflected by the second reflecting surface 14b2, so as to converge the same at or near the rear-side focal point $F_{14c}$ of the light exiting surface 14c with respect to the vertical direction.

Figure 15:
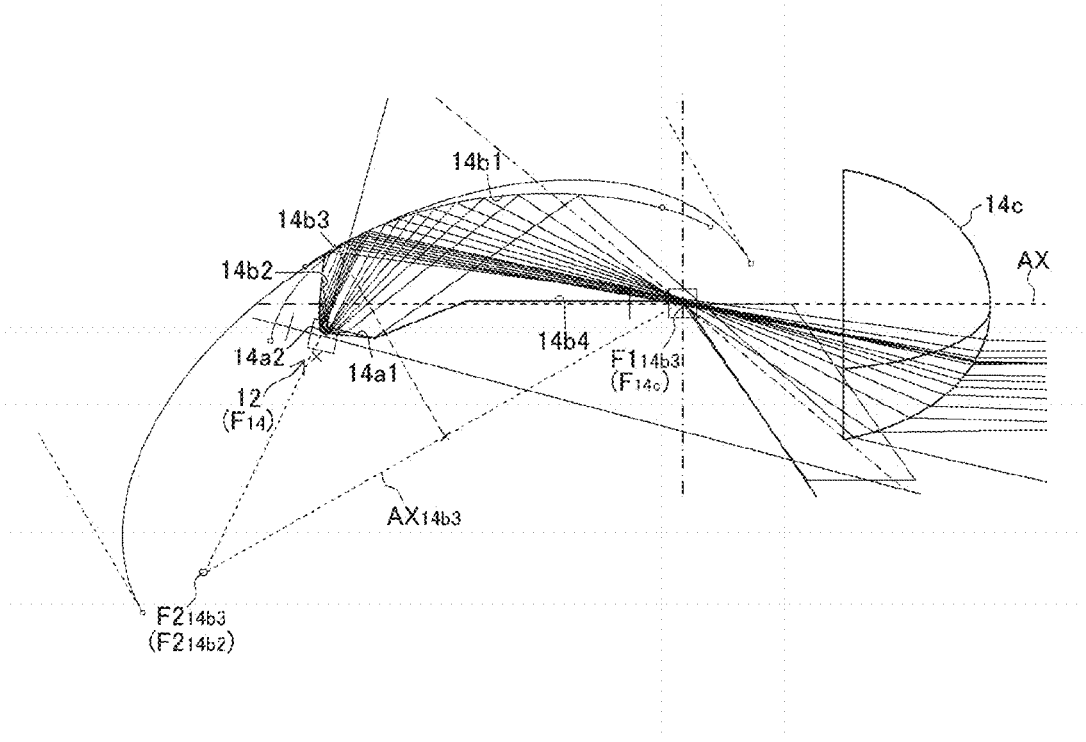
FIG. 15 is a vertical cross-sectional view illustrating the third reflecting surface 14*b*3.

Specifically, the third reflecting surface 14b3 in its vertical cross section as illustrated in FIG. 15 can be designed to be an ellipsoidal reflecting surface or a similar free curved surface, having a first focal point $F1_{14b3}$ at or near the rear-side focal point $F_{14c}$ of the light exiting surface 14c and a second focal point $F2_{14b3}$ at or near the other focal point $F2_{14b2}$. The third reflecting surface 14b3 with this configuration can internally reflect the second light rays Ray2 having been internally reflected by the second reflecting surface 14b2.

Note that the reflecting surface configured to internally reflect the second light rays Ray2 out of the ellipsoidal reflecting surface may vary depending on the material (refractive index) of the lens member 14, the ellipsoidal shape (the inclined angle and the length of the long axis $AX_{14b3}$ of the ellipsoidal shape with respect to the reference axis AX), the hyperbolic shape (the location of the other focal point $F2_{14b2}$), the inclined angle $\theta_L$ of the optical axis $AX_{12}$ of the light source 12 with respect to the vertical line Av, the shape of the rear incident surface 14a2 (the rear splitting angle $\theta_r$, the degree of refraction (convergence) of the second light rays Ray2, etc.), and therefore, it is difficult to define it with concrete numerical values. However, recent simulation software can find out the reflecting surface (namely, the third reflecting surface 14b3) configured to internally reflect the second light rays Ray2 out of the ellipsoidal reflecting surface by changing (adjusting) at least one factor such as the material (refractive index) of the lens member 14, the ellipsoidal shape (the inclined angle and the length of the long axis $AX_{14b3}$ of the ellipsoidal shape with respect to the reference axis AX), the hyperbolic shape (the location of the other focal point $F2_{14b2}$), the inclined angle $\theta_L$ of the optical axis $AX_{12}$ of the light source 12 with respect to the vertical line Av, the shape of the rear incident surface 14a2 (the rear splitting angle $\theta_r$, the degree of refraction (convergence) of the second light rays Ray2, etc.), etc., and, for every change, confirming the optical path for the second light rays Ray2 (or the light ray group from the light source point $F_{14}$) having entered the lens member 14 through the rear incident surface 14a2.

The third reflecting surface 14b3 in its horizontal cross section can be configured such that the low beam light distribution pattern P can have a desired horizontal light intensity distribution. Specifically, for example, the third reflecting surface 14b3 in its horizontal cross section can be a reflecting surface based on a basic ellipsoidal shape so as to obtain the low beam light distribution pattern P with a desired horizontal light intensity distribution.

Part of the second light rays Ray2 that have been incident on the rear incident surface 14a2 of the incident portion 14a to enter the lens member 14 and internally reflected by the second reflecting surface 14b2 and the third reflecting surface 14b3 can be shielded by the fourth reflecting surface 14b4. Another part (remaining part) of the second light rays Ray2 not shielded by the fourth reflecting surface 14b4 can exit through the lower surface 14c1 of the light exiting surface 14c below the reference axis AX to be projected forward, as illustrated in FIG. 4A. The projected light rays can thus form the lower face light distribution pattern $P2_{14c1}$ (see FIG. 4D) including the cut-off line at the upper end edge defined by the front end edge 14b5 of the fourth reflecting surface 14b4. On the other hand, the part of the second light rays Ray2 that have been incident on the rear incident surface 14a2 of the incident portion 14a to enter the lens member 14 and internally reflected by the second reflecting surface 14b2 and the third reflecting surface 14b3 can be internally reflected by the fourth reflecting surface 14b4 to be projected forward through the upper surface 14c2 of the light exiting surface 14c above the reference axis AX. The thus projected light rays can be directed to a road surface (see FIG. 4A). Specifically, the second light rays Ray2 having been internally reflected by the fourth reflecting surface 14b4 can form a pattern obtained by folding the original pattern at the cut-off line as a border to be superimposed on the lower portion thereof, whereby the upper face light distribution pattern $P2_{14c2}$ including the cut-off line at the upper end edge defined by the front end edge 14b5 of the fourth reflecting surface 14b4 (see FIG. 4C).

The second optical system with the above configuration can superimpose the lower face light distribution pattern $P2_{14c1}$ (see FIG. 4D) on the upper face light distribution pattern $P2_{14c2}$ (see FIG. 4C) to form the second partial light distribution pattern P2.

The first partial light distribution pattern P1 formed by the first optical system can be superimposed on the second partial light distribution pattern P2 formed by the second optical system, to thereby form the low beam light distribution pattern P as illustrated in FIG. 4B. As described, the low beam light distribution pattern P can include the upper end edge cut-off lines CL1 to CL3 defined by the front end edge 14b5 of the fourth reflecting surface 14b4.

The ratio of the light rays having entered through the front incident surface 14a1 and those through the rear incident surface 14a2 from the light source 12 can be controlled by adjusting the angle formed between the vertical line Av and the optical axis $AX_{12}$ of the light source 12 by rotating the light source 12 around itself or the light source point $F_{14}$.

For example, the light source 12 in the state shown in FIG. 5 can be rotated in a clockwise direction around itself (light source point $F_{14}$) so as to increase the angle formed between the optical axis $AX_{12}$ of the light source 12 and the vertical line Av, to thereby increase the amount of light (the first light ray Ray1) emitted from the light source 12 and entering the lens member 14. As a result, the first partial light distribution pattern P1 formed by the first light rays Ray1 can be increased in intensity (become brighter).

For example, the light source 12 in the state shown in FIG. 5 can be rotated in an anti-clockwise direction around itself (light source point $F_{14}$) so as to decrease the angle formed between the optical axis $AX_{12}$ of the light source 12 and the vertical line Av, to thereby increase the amount of light (the second light ray Ray2) emitted from the light source 12 and entering the lens member 14. As a result, the second partial light distribution pattern P2 formed by the second light rays Ray2 can be increased in intensity (become brighter).

According to the present exemplary embodiments described above, the lens member 14 and the vehicle lighting unit 10 including the same that can eliminate the metal deposition process which may cause cost increase and can also suppress the reflection loss (light loss).

This is because the provision of the incident portion 14*a* configured to allow the light rays from the light source 12 to enter the lens member 14 while dividing the entering light rays into the first light rays Ray1 that travel obliquely upward and forward and the second light rays Ray2 that travel obliquely upward and rearward; the first reflecting surface 14*b*1 configured to internally reflect the first light rays Ray1 ("internally reflect" means "totally reflect" with the theoretical reflectance of 100%); the second reflecting surface 14*b*2 configured to internally reflect the second light rays Ray2; the third reflecting surface 14*b*3 configured to internally reflect the second light rays Ray2 that have been internally reflected by the second reflecting surface 14*b*2; and the fourth reflecting surface 14*b*4 configured to internally reflect at least part of the first light rays Ray1 that have been internally reflected by the first reflecting surface 14*b* 1 and the second light rays Ray2 that have been internally reflected by the third reflecting surface 14*b*3.

In the present exemplary embodiment with the above-described configuration, it is possible to form the low beam light distribution pattern P with excellent far-side visibility by means of relatively high light intensity near the cut-off line. This is because the first light rays Ray1 having been internally reflected by the first reflecting surface 14*b*1 and the second light rays Ray2 having been internally reflected by the third reflecting surface 14*b*3 can be converged at or near the rear-side focal point $F_{14}$, of the light exiting surface 14*c* with respect to the vertical direction.

A description will now be given of modified examples.

In the above embodiments, the description has been given of the vehicle lighting unit (vehicle headlamp) for forming the low beam light distribution pattern P including its upper end edge of cut-off lines CL1 to CL3. However, the presently disclosed subject matter can be applied to other vehicle lighting units that form a light distribution pattern having an upper end edge cut-off line, such as a fog lamp. Further, the exemplified numerical values are illustrative and can appropriately be changed in accordance with the use purpose or the like.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A lens member, to be disposed in front of a light source, configured to include: a front end portion and a rear end portion, and to form a predetermined light distribution pattern including a cut-off line at an upper edge thereof by causing light rays emitted from the light source and entering the lens member to exit through the front end portion for irradiation, the lens member comprising:

an incident portion configured to allow the light rays from the light source to enter the lens member while dividing the entering light rays into first light rays that travel obliquely upward and forward and second light rays that travel obliquely upward and rearward;

a first reflecting surface configured to internally reflect the first light rays;

a second reflecting surface configured to internally reflect the second light rays;

a third reflecting surface configured to internally reflect the second light rays that have been internally reflected by the second reflecting surface;

a fourth reflecting surface configured to internally reflect at least part of the first light rays that have been internally reflected by the first reflecting surface and the second light rays that have been internally reflected by the third reflecting surface; and a light exiting surface disposed at the front end portion and configured to be a convex lens surface having a rear-side focal point, wherein the fourth reflecting surface is configured to be a reflecting surface having a front end edge and extending rearward from a position at or near the rear-side focal point of the light exiting surface, the incident portion, the first reflecting surface, the fourth reflecting surface, and the light exiting surface constitute a first optical system configured to form a first partial light distribution pattern including a cut-off line at an upper end edge thereof defined by the front end edge of the fourth reflecting surface, the first partial light distribution pattern being formed by irradiating, forward through the light exiting surface, light rays not shielded by the fourth reflecting surface and light rays internally reflected by the fourth reflecting surface out of the first light rays having entered the lens member through the incident portion and been internally reflected by the first reflecting surface, the incident portion, the second reflecting surface, the third reflecting surface, the fourth reflecting surface, and the light exiting surface constitute a second optical system configured to form a second partial light distribution pattern including a cut-off line at an upper end edge thereof defined by the front end edge of the fourth reflecting surface, the second partial light distribution pattern being formed by irradiating, forward through the light exiting surface, light rays not shielded by the fourth reflecting surface and light rays internally reflected by the fourth reflecting surface out of the second light rays having entered the lens member through the incident portion and been internally reflected by the second reflecting surface and the third reflecting surface in order, the predetermined light distribution pattern is formed by superposing the first partial light distribution pattern and the second partial light distribution pattern upon each other as a synthetic light distribution pattern the second reflecting surface is configured to internally reflect the second light rays to direct the internally reflected second light rays to the third reflecting surface, the third reflecting surface is configured to internally reflect the second light rays having been internally reflected by the second reflecting surface to converge the internally reflected second light rays to a position at or near the rear-side focal point of the light exiting surface with respect to the vertical direction the second reflecting surface is a reflecting surface in a hyperbolic shape having two focal points, being one focal point disposed at or near a virtual focal point that is an intersection where the second light rays assumed to travel in a reverse direction intersect with each other and the other focal point disposed below the light source, and the third reflecting surface is a reflecting surface in an ellipsoidal shape having a first focal point disposed at or near the rear-side focal point of the light exiting surface and a second focal point disposed at or near the other focal point of the second reflecting surface.

2. The lens member according to claim 1, wherein the incident portion is configured to include a front incident surface and a rear incident surface, and the front incident surface has a rear end edge and the rear incident surface has a front end edge so that the rear end edge and the front end edge are connected to each other to take a V shape opened toward the light source to surround the light source while the connected front and rear incident surfaces are disposed in front of the light source, so that the light rays emitted from the light source are incident on the front incident surface as the first light rays and on the rear incident surface as the second light rays.

3. The lens member according to claim 2, wherein the third reflecting surface is disposed in a space between a first light path in which the first light rays travel and a second light path in which the second light rays travel so that the first light rays and the second light rays having entered the lens member through the incident portion are not directly incident on the third reflecting surface.

4. The lens member according to claim 3, wherein the first reflecting surface is configured to internally reflect and converge the first light rays at or near the rear-side focal point of the light exiting surface with respect to a vertical direction.

5. The lens member according to claim 4, wherein the first reflecting surface is formed by an ellipsoidal reflecting surface configured to have a first focal point disposed at or near the rear-side focal point of the light exiting surface and a second focal point disposed at or near a virtual focal point that is an intersection where the first light rays assumed to travel in a reverse direction intersect with each other.

6. The lens member according to claim 2, wherein the first reflecting surface is configured to internally reflect and converge the first light rays at or near the rear-side focal point of the light exiting surface with respect to a vertical direction.

7. The lens member according to claim 6, wherein the first reflecting surface is formed by an ellipsoidal reflecting surface configured to have a first focal point disposed at or near the rear-side focal point of the light exiting surface and a second focal point disposed at or near a virtual focal point that is an intersection where the first light rays assumed to travel in a reverse direction intersect with each other.

8. The lens member according to claim 1, wherein the third reflecting surface is disposed in a space between a first light path in which the first light rays travel and a second light path in which the second light rays travel so that the first light rays and the second light rays having entered the lens member through the incident portion are not directly incident on the third reflecting surface.

9. The lens member according to claim 8, wherein the first reflecting surface is configured to internally reflect and converge the first light rays at or near the rear-side focal point of the light exiting surface with respect to a vertical direction.

10. The lens member according to claim 9, wherein the first reflecting surface is formed by an ellipsoidal reflecting surface configured to have a first focal point disposed at or near the rear-side focal point of the light exiting surface and a second focal point disposed at or near a virtual focal point that is an intersection where the first light rays assumed to travel in a reverse direction intersect with each other.

11. The lens member according to claim 1, wherein the first reflecting surface is configured to internally reflect and converge the first light rays at or near the rear-side focal point of the light exiting surface with respect to a vertical direction.

12. The lens member according to claim 11, wherein the first reflecting surface is formed by an ellipsoidal reflecting surface configured to have a first focal point disposed at or near the rear-side focal point of the light exiting surface and a second focal point disposed at or near a virtual focal point that is an intersection where the first light rays assumed to travel in a reverse direction intersect with each other.

13. A vehicle lighting unit comprising a light source, and the lens member according to claim 1.

14. A lens member, to be disposed in front of a light source, configured to include: a front end portion and a rear end portion, and to form a predetermined light distribution pattern including a cut-off line at an upper edge thereof by causing light rays emitted from the light source and entering the lens member to exit through the front end portion for irradiation, the lens member comprising:

an incident portion configured to allow the light rays from the light source to enter the lens member while dividing the entering light rays into first light rays that travel obliquely upward and forward and second light rays that travel obliquely upward and rearward;

a first reflecting surface configured to internally reflect the first light rays;

a second reflecting surface configured to internally reflect the second light rays;

a third reflecting surface configured to internally reflect the second light rays that have been internally reflected by the second reflecting surface;

a fourth reflecting surface configured to internally reflect at least part of the first light rays that have been internally reflected by the first reflecting surface and the second light rays that have been internally reflected by the third reflecting surface; and a light exiting surface disposed at the front end portion and configured to be a convex lens surface having a rear-side focal point, wherein the fourth reflecting surface is configured to be a reflecting surface having a front end edge and extending rearward from a position at or near the rear-side focal point of the light exiting surface, the incident portion, the first reflecting surface, the fourth reflecting surface, and the light exiting surface constitute a first optical system configured to form a first partial light distribution pattern including a cut-off line at an upper end edge thereof defined by the front end edge of the fourth reflecting surface, the first partial light distribution pattern being formed by irradiating, forward through the light exiting surface, light rays not shielded by the fourth reflecting surface and light rays internally reflected by the fourth reflecting surface out of the first light rays having entered the lens member through the incident portion and been internally reflected by the first reflecting surface, the incident portion, the second reflecting surface, the third reflecting surface, the fourth reflecting surface, and the light exiting surface constitute a second optical system configured to form a second partial light distribution pattern including a cut-off line at an upper end edge thereof defined by the front end edge of the fourth reflecting surface, the second partial light distribution pattern being formed by irradiating, forward through the light exiting surface, light rays not shielded by the fourth reflecting surface and light rays internally reflected by the fourth reflecting surface out of the second light rays having entered the lens member through the incident portion and been internally reflected by the second reflecting surface and the third reflecting surface in order, the predetermined light distribution pattern is formed by superposing the first partial light distribution pattern and the second partial light distribution pattern upon each other as a synthetic light distribution pattern, the first reflecting surface is a reflecting surface in an ellipsoidal shape or a substantially ellipsoidal shape having first and second focal points, and the third reflecting surface is a reflecting surface in an ellipsoidal shape or a substantially ellipsoidal shape having first and second focal points, and the first focal points of the first and third reflecting surfaces are each located at or near the rear-side focal point of the light exiting surface, and the second focal points of the first and third reflecting surfaces are located at respective different positions.

* * * * *